US010514227B1

(12) United States Patent
Kempf et al.

(10) Patent No.: US 10,514,227 B1
(45) Date of Patent: Dec. 24, 2019

(54) MULTI-DRAW WEIGHT ARCHERY BOW WITH CABLE TIMING

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 16/185,523

(22) Filed: Nov. 9, 2018

Related U.S. Application Data

(62) Division of application No. 15/678,150, filed on Aug. 16, 2017, now Pat. No. 10,139,189, which is a division of application No. 15/341,016, filed on Nov. 15, 2016, now Pat. No. 9,945,634.

(51) Int. Cl.
*F41B 5/12* (2006.01)
*F41B 5/10* (2006.01)

(52) U.S. Cl.
CPC ..... *F41B 5/123* (2013.01); *F41B 5/10* (2013.01)

(58) Field of Classification Search
CPC ..... F41B 5/10; F41B 5/123
See application file for complete search history.

(56) References Cited

U.S. PATENT DOCUMENTS 3,486,495 A 12/1969 Allen
3,812,835 A * 5/1974 Smith ..... F41B 5/0094 124/25.6
4,192,280 A * 3/1980 Rickard ..... F41B 5/10 124/25.6
4,201,177 A * 5/1980 Holman ..... F41B 5/10 124/25.6
4,781,167 A * 11/1988 Martin ..... F41B 5/10 124/25.6
5,381,777 A * 1/1995 Mitchell ..... F41B 5/10 124/23.1
5,499,618 A * 3/1996 Thompson ..... F41B 5/0094 124/25.6
5,606,963 A * 3/1997 Wenzel ..... F41B 5/10 124/25.6
8,434,463 B2 5/2013 Bednar et al.

* cited by examiner

*Primary Examiner* — John A Ricci
(74) *Attorney, Agent, or Firm* — Donald J. Ersler

(57) ABSTRACT

A multi-draw weight archery bow with cable timing includes a shooting bow and a timing-draw device. The shooting bow includes a riser, a barrel, a first limb, a second limb, a first cam, a second cam, a bowstring, a first cable and a second cable. A rotational timing-draw device includes a rotational timing housing and a rotational timing hub. The rotational timing housing is mounted in a limb. A cable is secured to the rotational timing hub and the rotational timing hub is secured to the rotational timing housing. A multi-position draw weight and rotation device includes a multi-position and rotational draw timing hub and the rotational timing housing. The end of a cable is secured to one of four positions on the multi-position and rotation draw timing hub. A multi-position draw weight device includes a multi-position adjustable draw weight plate and a timing housing.

3 Claims, 12 Drawing Sheets

MULTI-DRAW WEIGHT ARCHERY BOW WITH CABLE TIMING

CROSS-REFERENCES TO RELATED APPLICATIONS

This is a divisional application, which takes priority from patent application Ser. No. 15/678,150, filed on Aug. 16, 2017, which takes priority from patent application Ser. No. 15/341,016 filed on Nov. 2, 2016, now U.S. Pat. No. 9,945,634, issued on Apr. 17, 2018.

BACKGROUND OF THE INVENTION

Field of the Invention

The present invention relates generally to archery and more specifically to a multi-draw weight archery bow with cable timing, which allows adjustment of draw weight and/or cable timing.

Discussion of the Prior Art

Historically, archery bows only had a few methods of being able to alter the draw weight of the bow; loosen or tighten the limb anchor bolt, which alters the amount of stress placed upon the limb, or put limbs on the bow that have a greater or lesser measured draw weight. In the case of Bednar U.S. Pat. No. 8,434,463, the user could alter the draw weight of the crossbow by changing the location of the bow on the barrel of a crossbow. Though these methods all work to some extent, there is a need for an easier, more economical approach to change the draw weight of a bow. The present invention prescribes a method wherein the draw weight may be changed on any given bow, by changing the location of where an end of a bow cable is anchored. Further, it has been difficult to adjust the timing of the string guides without removal of the cable from the string guide or anchor. In order to adjust the timing of a typical shooting bow, a multi-step process has to be done multiple times. This process requires that the user have a bow press. The user puts the shooting bow into the bow press, and releases the pressure of the limbs on the cables. Typically, a second end of the cable must be removed from a cable post; then the cable would be twisted or untwisted and next the cable must be put back on the cable post. Further, the bow must be removed from the bow press; inspected and if the user was not accurate in a first attempt, subsequent attempts must be made until proper timing is achieved. The present invention prescribes a method in which a user may adjust the timing of the cables on an archery bow without removing an end of the cable from the cable post, or needing a bow press.

A typical bow string or cable is made using several small strands of material wrapped upon each other and twisted. After twisting of the main strands of material, another separate strand of material is wrapped about at least part of the length of the material, starting a short distance from the ends of the string or cable. By starting a short distance from the ends of the string or cable, end loops are formed. These end loops are then used to connect the string or cable to their perspective anchoring locations.

The shortening of a typical string or cable of an archery bow is accomplished by further twisting a second end of the string or the cable, which may be called twisting in a first direction. The lengthening of a typical string or cable of an archery bow is accomplished by twisting the second end of the string or the cable in the opposite direction in which it was made, which may be called twisting in a second direction.

Accordingly, there is a clearly felt need in the art for a multi-draw weight archery bow with cable timing, which allows adjustment of draw weight and/or cable timing.

SUMMARY OF THE INVENTION

The present invention provides a multi-draw weight archery bow with cable timing, which allows adjustment of draw weight and/or cable timing. A multi-draw weight archery bow with cable timing includes a shooting bow and a timing-draw device. The shooting bow includes a riser, a barrel, a first limb, a second limb, a first cam, a second cam, a bowstring, a first cable and a second cable. The riser is attached to the barrel. The first limb extends from a first end of the riser and the second limb extends from a second end of the riser. The first cam pivotally retained on a distal end of the first limb and the second cam is pivotally retained on a distal end of the second limb. A first end of the bowstring is retained on the first cam and a second end of the bow string is retained on the second cam. A rotational timing-draw device includes a rotational timing housing and a rotational timing hub. The rotational timing housing is mounted in a limb. A cable is secured to the rotational timing hub and the rotational timing hub is retained in the rotational timing housing. Rotating the rotational timing hub relative to rotational timing housing changes the tension on the cable, which results in timing changes between the first and second cams and the draw weight of the shooting bow.

A multi-position draw weight device includes a multi-position adjustable draw weight plate and a timing housing. The end of a cable is secured to one of multiple positions on the multi-position and rotation draw weight plate. Anchoring ends of the cables closer to an adjacent limb results in a greater draw weight. A multi-position draw weight and rotation device includes a multi-position and rotational draw timing hub and the rotational timing housing. The multi-position draw weight and rotation device includes all of the features of the rotational timing-draw device and the multi-position draw weight device.

Accordingly, it is an object of the present invention to provide a multi-draw weight archery bow with cable timing, which allows adjustment of draw weight and/or cable timing.

These and additional objects, advantages, features and benefits of the present invention will become apparent from the following specification.

DETAILED DESCRIPTION OF THE PREFERRED EMBODIMENTS

Figure 1:
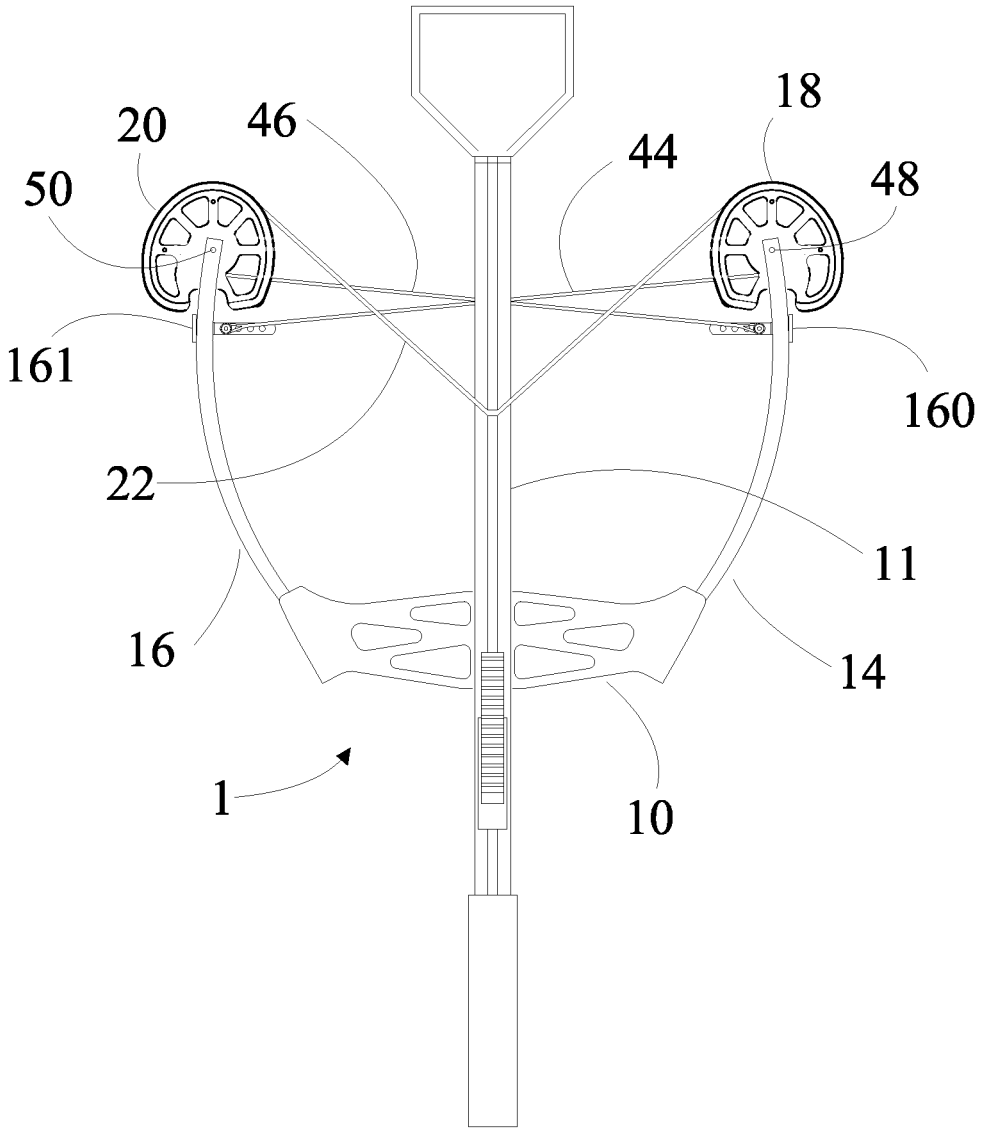
FIG. 1 is a top view of an archery crossbow where a first end of first and second cables are secured to a first position of a multi-position draw weight adjustment assembly having four positions of the present invention.
Figure 2:
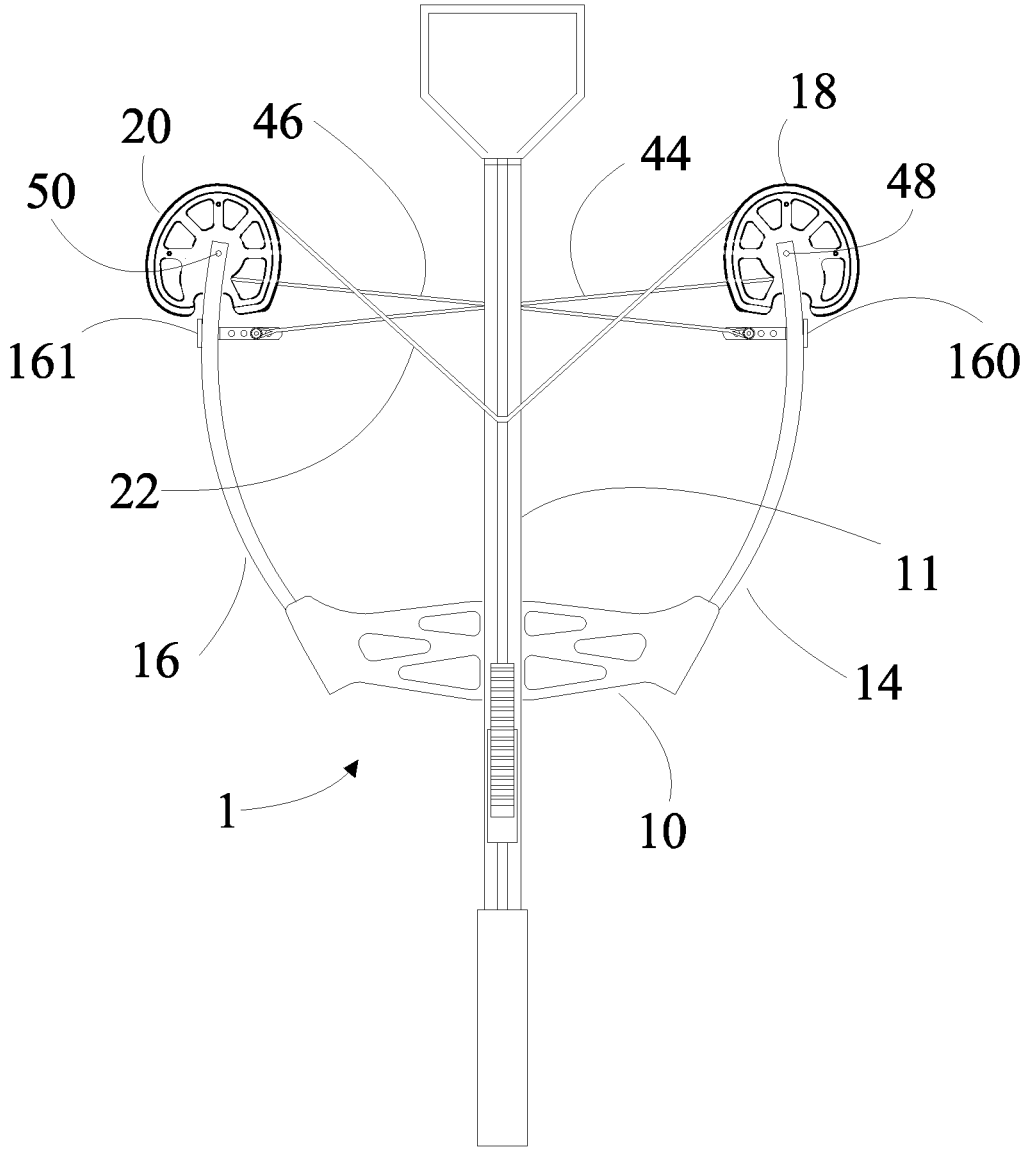
FIG. 2 is a top view of an archery crossbow where a first end of first and second cables are secured to a second position of a multi-position draw weight adjustment assembly having four positions of the present invention.
Figure 2A:
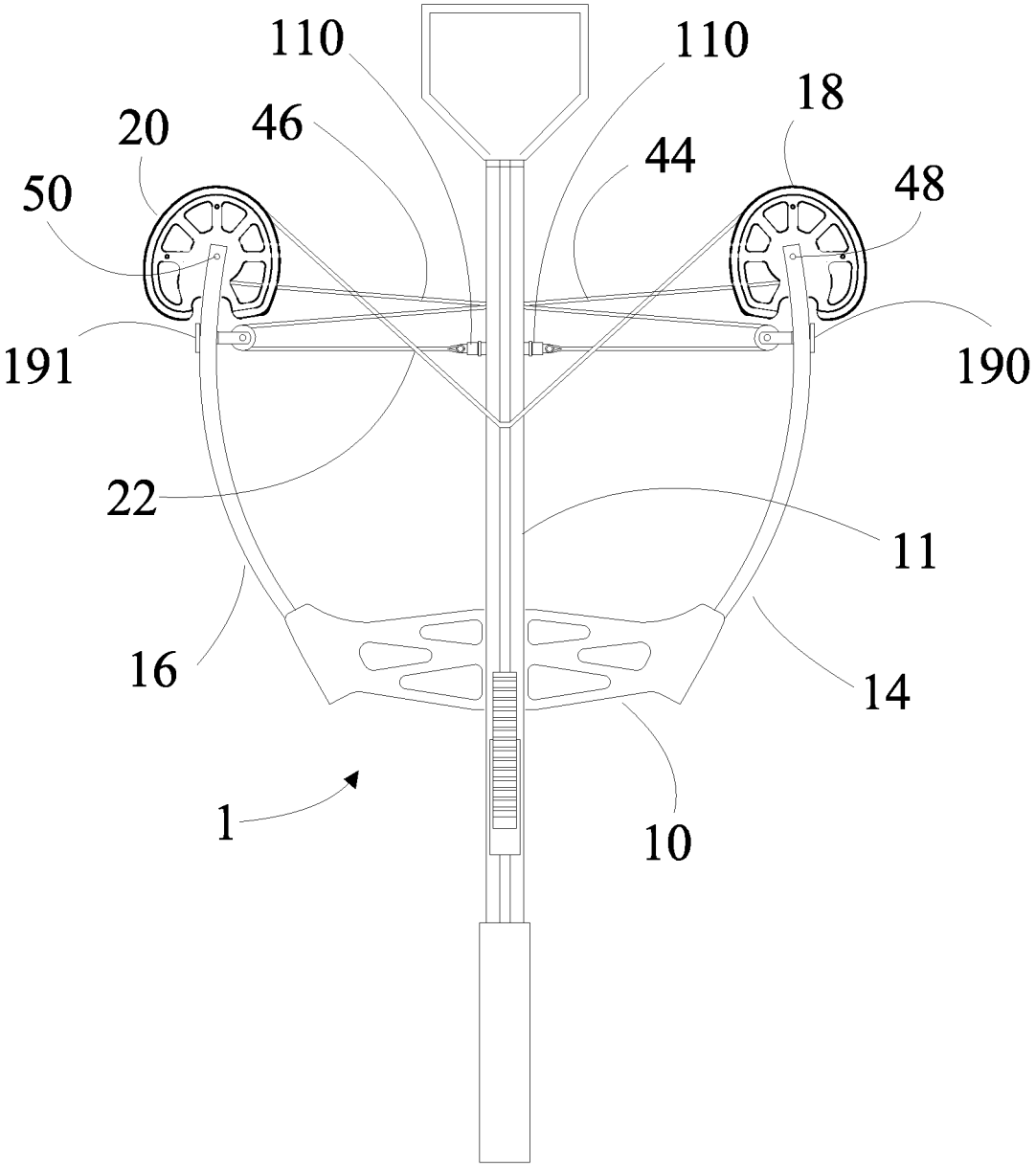
FIG. 2*a* is a top view of an archery crossbow where a first end of first and second cables are secured on first and second cams, a mid-span of the first and second cables are retained on pulleys located on opposing limbs, a second end of the first and second cables are secured to a barrel with rotational timing hubs of the present invention.
Figure 15:
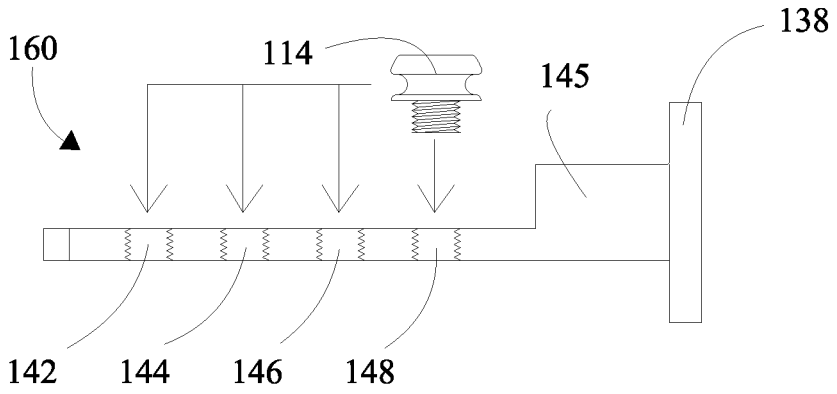
FIG. 15 is an exploded side view of an alternative multi-position rotational timing hub, where a cable post may be located in a first, second, third or fourth position, any of the positions allow for the alteration of draw weight of the bow of the present invention.
Figure 16:
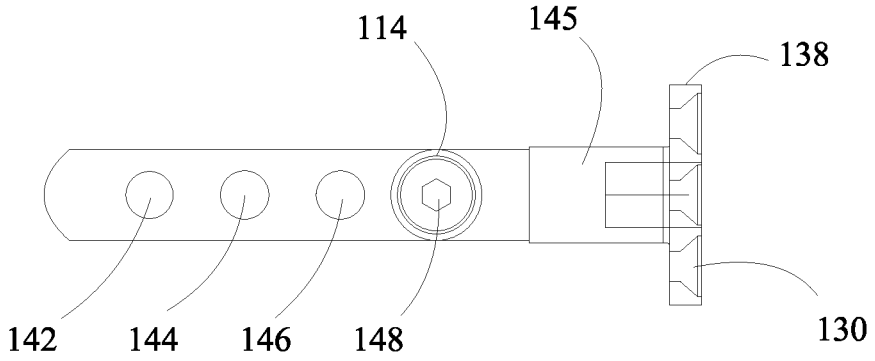
FIG. 16 is a top view of an alternative multi-position rotational timing hub, where a cable post is located in a first position of a draw weight adjustment of the present invention.
Figure 17:
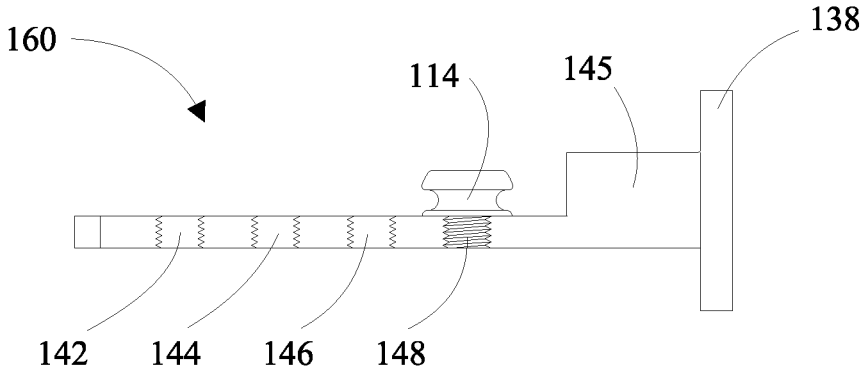
FIG. 17 is a side view of an alternative multi-position rotational timing hub, where a cable post is located in a first position of a draw weight adjustment of the present invention.
Figure 18:
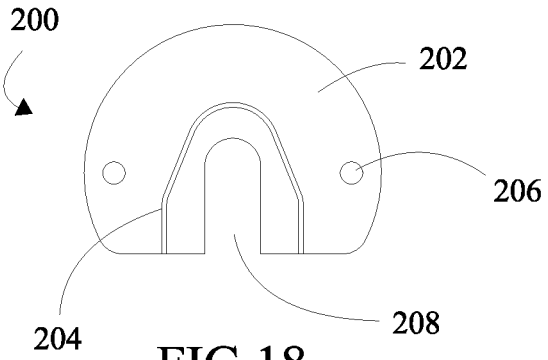
FIG. 18 is a top view of an alternative multi-position draw weight adjustment housing of the present invention.
Figure 19:
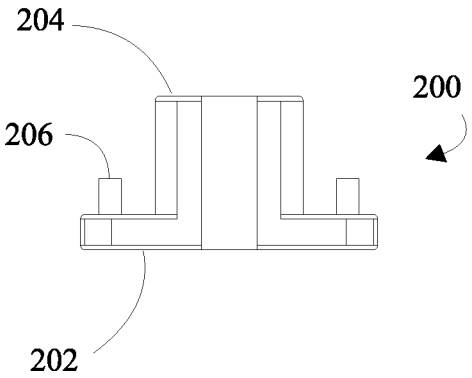
FIG. 19 is a front view of an alternative multi-position draw weight adjustment housing of the present invention.
Figure 20:
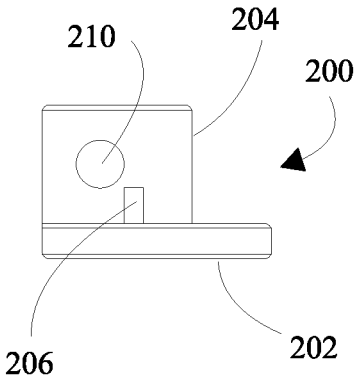
FIG. 20 is a side view of an alternative multi-position draw weight adjustment housing of the present invention.
Figure 21:
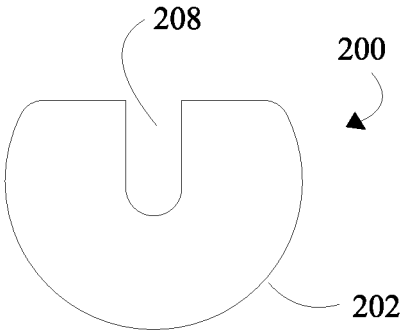
FIG. 21 is a bottom view of an alternative multi-position draw weight adjustment housing of the present invention.

With reference now to the drawings, and particularly to FIG. 1, there is shown a top view of a shooting bow 1. The crossbow 1 includes a riser 10, a barrel 11, a first limb 14, a second limb 16, a first cam 18, a second cam 20, a bowstring 22, a first cable 44 and a second cable 46. The riser 10 is attached to the barrel 11. The first limb 14 extends from a first end of the riser 10 and the second limb 16 extends from a second end of the riser 10. The first cam 18 pivotally retained on a distal end of the first limb 14 and the second cam 20 is pivotally retained on a distal end of the second limb 16. A first end of the bowstring 22 is retained on the first cam 18 and a second end of the bow string 22 is retained on the second cam 20. With reference to FIGS. 15-17, first and second multi-position draw weight adjustment assemblies 160, 161 are inserted through first and second openings formed through the first and second limbs 14, 16. With reference to FIGS. 15-17, the first and second adjustment assemblies 160, 161 preferably include four adjustment positions. A cable post 114 of the first and second adjustment assemblies 160, 161 is retained in a first position 148. One end of the first cable 44 is secured to the second adjustment assembly 161 and the other end of the first cable 44 is secured to the first cam 18. One end of the second cable 46 is secured to the first adjustment assembly 160 and the other end is secured to the second cam 20. With reference to FIG. 2, the cable post 114 is retained in a second position 144 of the first and second adjustment assemblies 160, 161.

With reference to FIGS. 2*a*, 8-10, 13 and 14, the crossbow 1 includes the first cable 44, the second cable 46, two rotational timing hubs 110 and two pulleys 190, 191. A first end of the first cable 44 is secured to the first cam 18. A first end of the second cable 46 is secured to the second cam 20. Substantially a span of the first cable 44 is retained on the pulley 191 secured on the second limb 16. Substantially a span of the second cable 46 is retained on the pulley 190 secured on the first limb 14. The second end of the first cable 44 is retained on the rotational timing hub 110 attached to a second side of the barrel 11. The second end of the second cable 46 is retained on the rotational timing hub 110 attached to a first side of the barrel 11.

With reference to FIGS. 3 and 5-12, first and second rotational timing assemblies 120, 121 are inserted through first and second openings formed through the first and second limbs 14, 16 of the crossbow 1. The first and second rotational timing hubs 110 are oriented in a first position. In the event that the timing of the first cam 18 is not in unison with the second cam 20, a tool may be inserted into a hex cavity 118 of the first single position rotational timing hub 110, or the second single position rotational timing hub 110. The tool is used to rotate the first or said second single position rotational timing hub 110 in a clockwise or counterclockwise direction to lengthen or shorten the first or second cable 44, 46.

Figure 4:
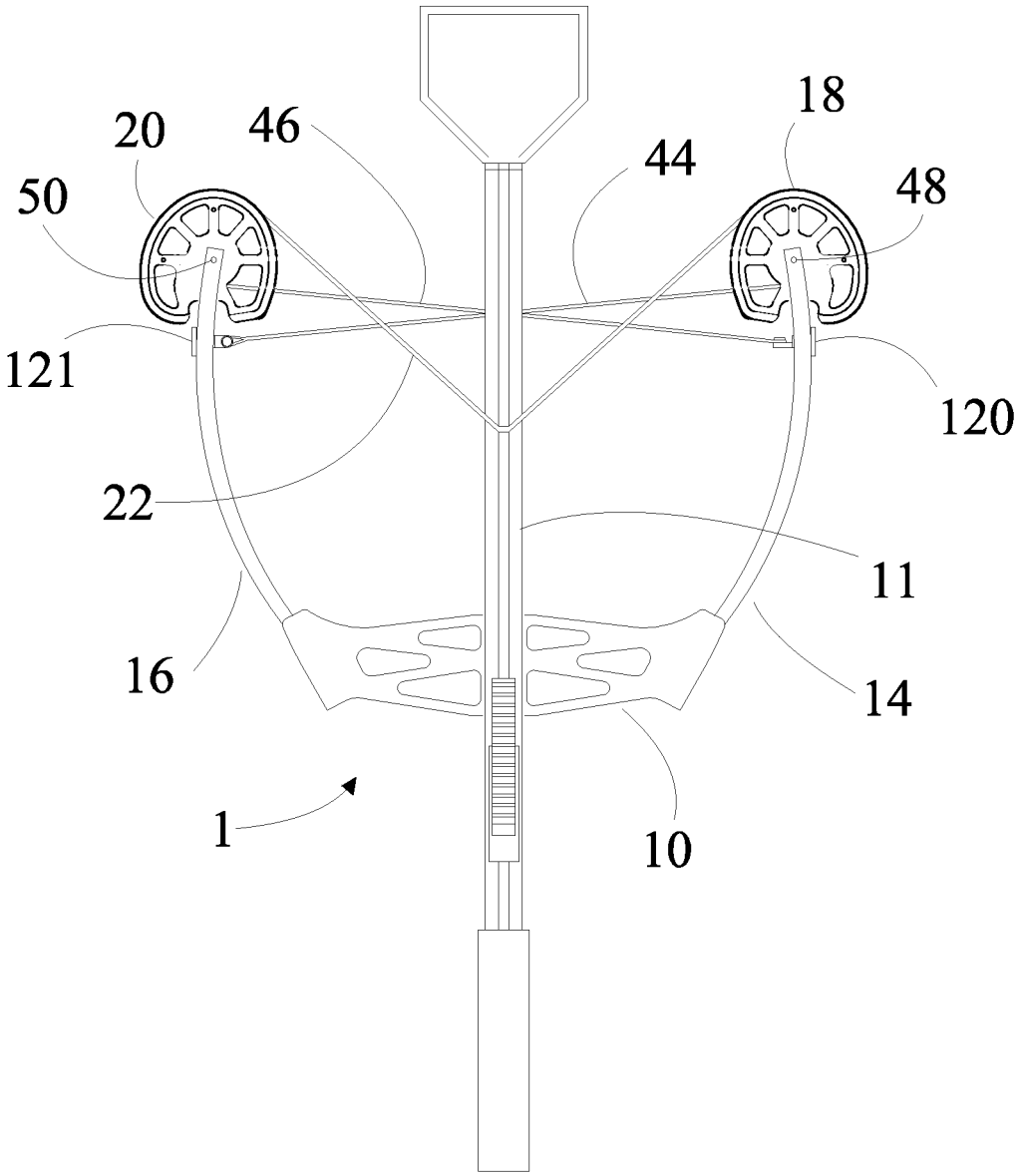
FIG. 4 is a top view of an archery crossbow of the present invention, where the second end of the first and second cables are coupled to the limbs at a first location, where the first rotational timing adjustment assembly is at a first position, and the second rotational timing adjustment assembly is at a second position of the present invention.
Figure 7:
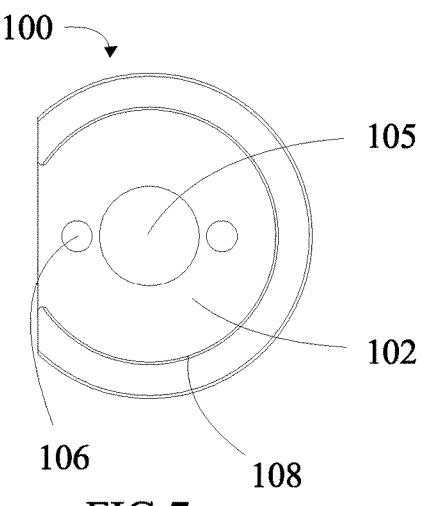
FIG. 7 is a bottom view of a rotational timing adjustment housing of the present invention.
Figure 6:
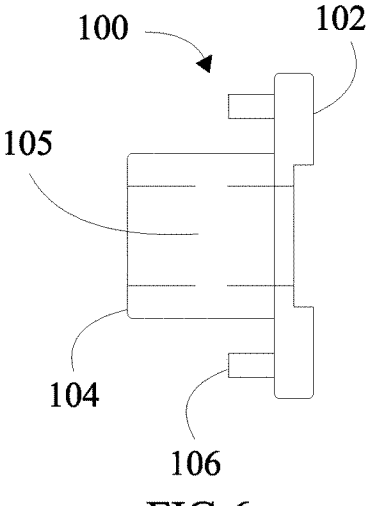
FIG. 6 is a side view of a rotational timing adjustment housing of the present invention.
Figure 5:
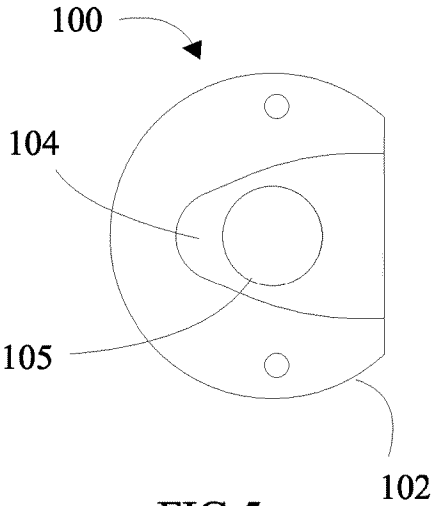
FIG. 5 is a top view of a rotational timing adjustment housing in accordance with of the present invention.
Figure 10:
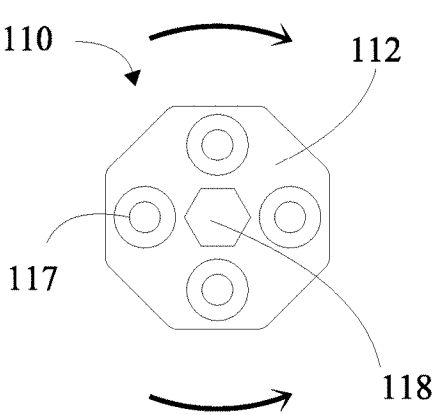
FIG. 10 is an opposing end view of a single position rotational timing hub of the present invention.
Figure 9:
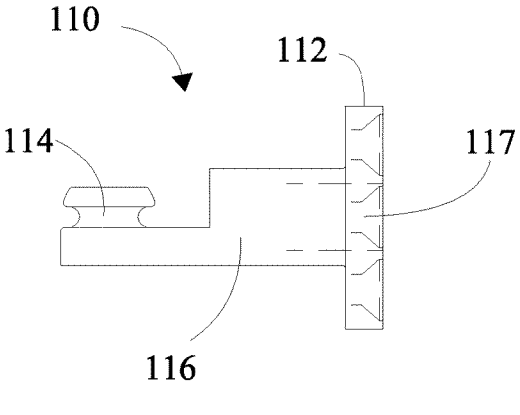
FIG. 9 is a side view of a single position rotational timing hub of the present invention.
Figure 8:
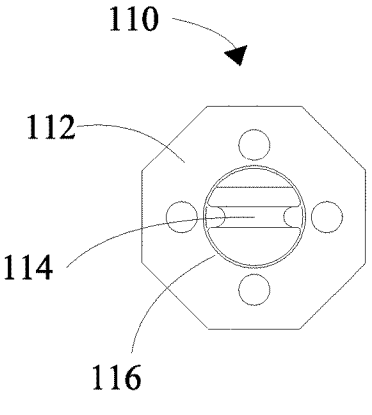
FIG. 8 is an end view of a single position rotational timing hub of the present invention.
Figure 12:
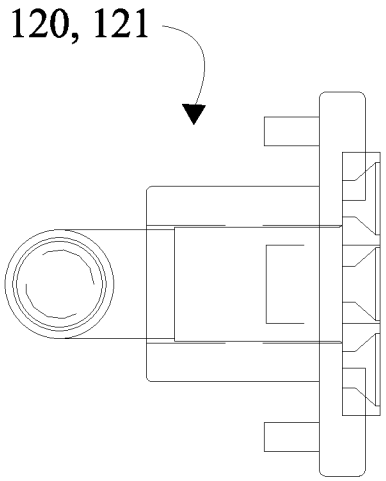
FIG. 12 is a side view of the assembly of a rotational timing adjustment housing and a single position rotational timing hub of the present invention.
Figure 11:
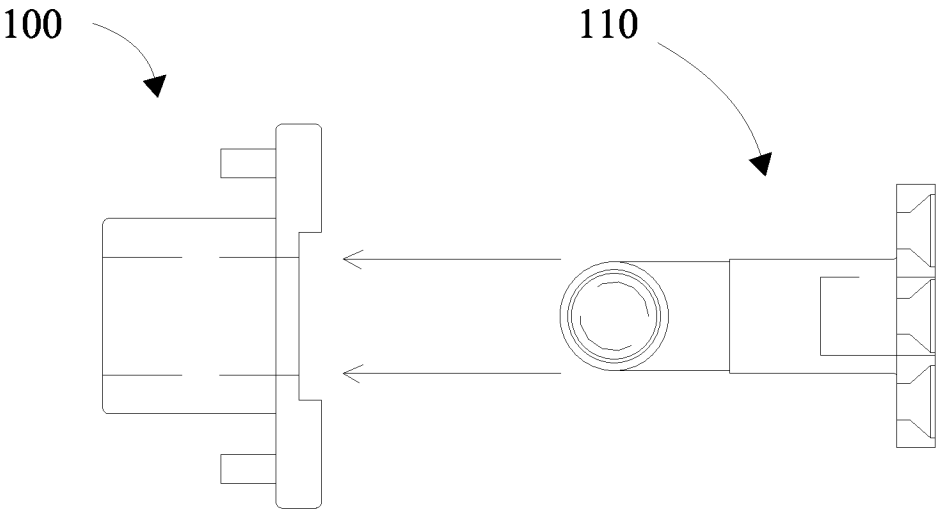
FIG. 11 is an exploded side view of a rotational timing adjustment housing and a single position rotational timing hub prior to assembly of the present invention.

With reference to FIG. 4, the first rotational timing assembly 120 includes a rotational timing hub 110 rotated to a second position. With reference to FIGS. 5-10, the first and second rotation timing assemblies 120 include a rotational timing housing 100 and the rotational timing hub 110. The rotational timing hub 110 includes a head portion 112, a cable post 114 and a mid-section 116. The mid-section 116 extends from one side of the head portion 112. The cable post 114 is retained in the mid-section 116. A plurality of fastener openings 117 are formed through the head portion 112. The hex cavity 118 or the like cavity is formed in the head portion 112 to receive a hex driver or the like driver. The hex cavity 118 could be replaced with a pair of parallel flats formed on an outer perimeter of the head portion 112.

The rotation timing housing 100 includes a head flange 102, a hub retainer 104 and a pair of pins 106. A hub bore 105 is formed through the hub retainer 104. The pair of pins 106 extend from the head flange 102. Two holes are formed in the first and second limbs 14, 16 to receive the pair of pins 106 to prevent rotation of the rotation timing housing 100 relative to the first and second limbs 14, 16. A counterbore 108 is formed in head flange 102. The mid-section 116 of the rotational timing hub 110 is inserted through the hub bore 105 in the rotational timing housing 100. The rotation timing hub 110 is secured to the rotational timing housing 100 with at least one screw (not shown) inserted through the at least one hole 117 and threaded into the head flange 102.

Figure 13:
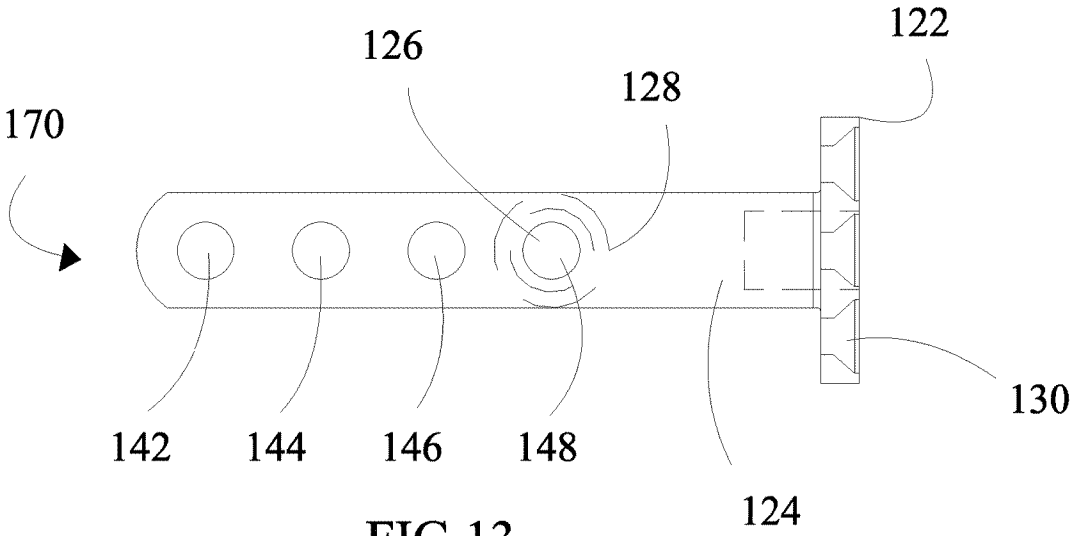
FIG. 13 is a top view of a multi-position rotational timing hub of the present invention.
Figure 14:
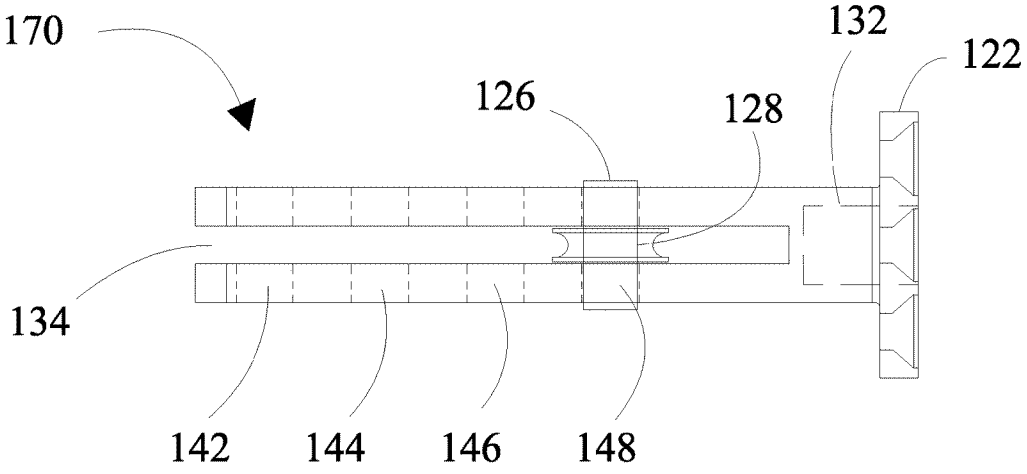
FIG. 14 is a side view of a multi-position rotational timing hub of the present invention.

With reference to FIGS. 13-14, a combination multi-position and rotational draw timing hub 170 includes a head flange 122, an anchor yoke 124, an anchor shaft 126 and an anchor pulley 128. The anchor yoke 124 extends from a side of the head flange 122. A plurality of fastener holes 130 are formed through the head flange 122. A hex cavity 132 is formed through the head flange 122 and into the anchor yoke 124 to receive a hex driver. The anchor yoke 124 includes a slot 134, which is sized to receive a height of the anchor pulley 128. Four position holes 142, 144, 146 and 148 are formed through the anchor yoke 124 to receive the anchor shaft 126. A shaft bore 136 is formed through the anchor pulley 128 to receive the anchor shaft 126. The combination multi-position and rotational draw timing hub 170 is inserted through the at least one hole 130 and secured in the rotational timing housing 100 with at least one screw (not shown) threaded into the head flange 102. The combination multi-position and rotational draw timing hub 170 is secured to the rotational timing housing 100 with at least one screw (not shown) inserted through the at least one hole 130 and threaded into the head flange 102.

With reference to FIGS. 15-17, a combination multi-position and rotational draw timing hub 160 includes a head flange 138, a post retainer 145 and the cable post 114. The post retainer 145 extends from one side of the head flange 138. Threaded position holes 142, 144, 146 and 148 are formed through the post retainer 145 to threadably receive the anchor cable post 114. The plurality of fastener holes 130 are formed through the head flange 138. A hex cavity 132 is formed through the head flange 122 and into the post retainer 145 to receive a hex driver. The combination multi-position and rotational timing hub 160 is secured to the rotational timing housing 100 with at least one screw (not shown) inserted through the at least one hole 130 and threaded into the head flange 102.

Figure 22:
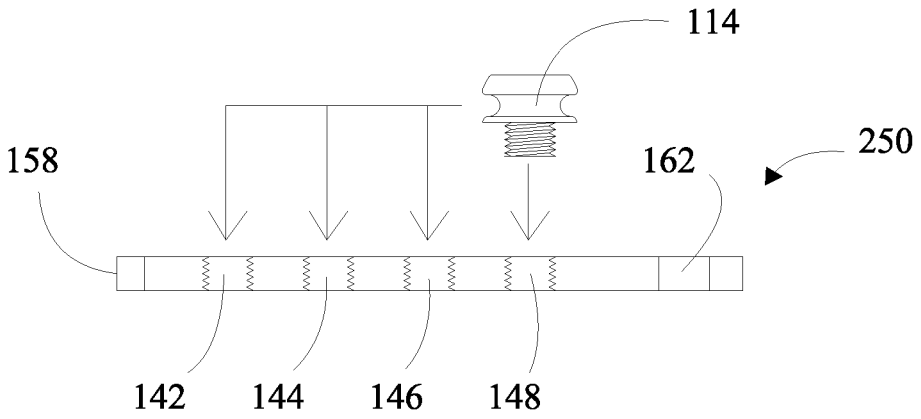
FIG. 22 is an exploded side view of an alternative multi-position draw weight adjustment bar and a cable post, where the cable post may be mounted in first, second, third, or fourth positions, the positions allow for the alteration of draw weight of the bow of the present invention.
Figure 23:
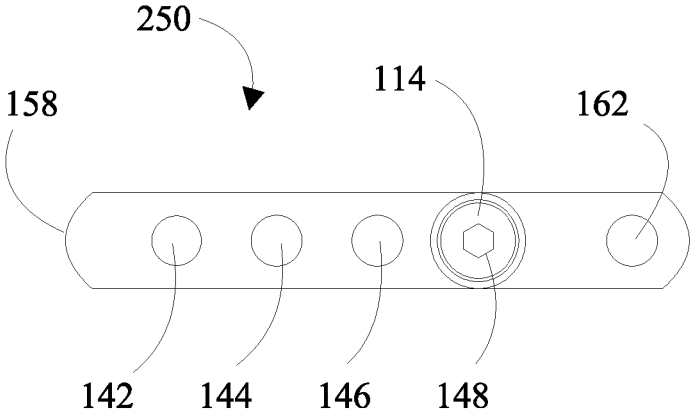
FIG. 23 is a top view of an alternative multi-position draw weight adjustment bar, where a cable post is shown in a first position of draw weight adjustment of the present invention.
Figure 24:
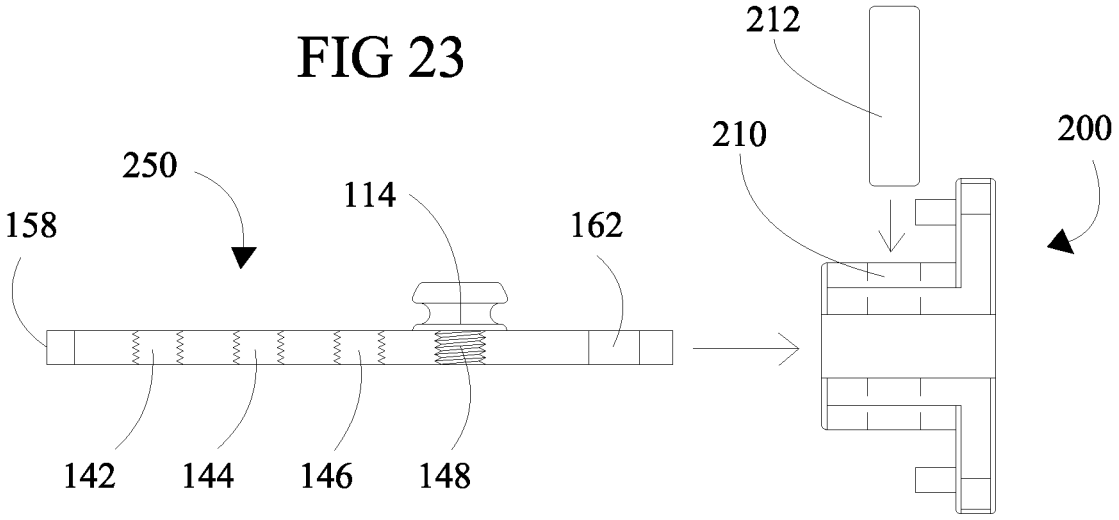
FIG. 24 is a partially exploded side view of an alternative multi-position draw weight adjustment bar and a multi-position draw weight adjustment housing prior to assembly, where a cable post is shown in a first position of the draw weight adjustment of the present invention.
Figure 25:
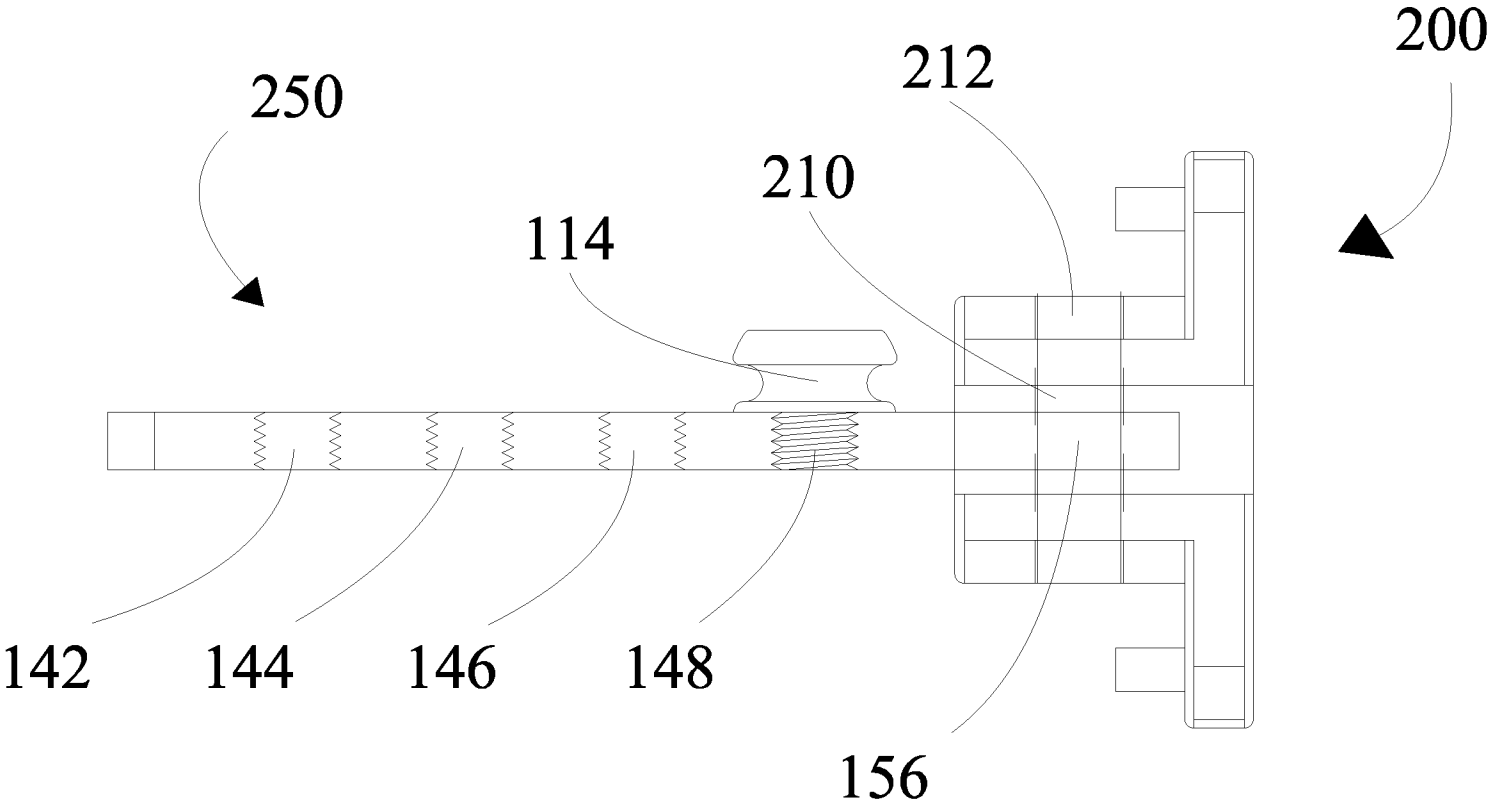
FIG. 25 is a side view of an assembly of an alternative multi-position draw weight adjustment bar and a multi-position draw weight adjustment housing, where a cable post is shown in the first position of a draw weight adjustment of the present invention.

FIGS. 18-21 show a timing housing 200. The timing housing 200 includes a head flange 202, a hub retainer 204 and a pair of pins 206. With reference to FIG. 22, a hub slot 208 is formed in the hub retainer 204 to receive a multi-position adjustable draw weight plate 250. With reference to FIG. 24, a dowel hole 210 is formed through the hub retainer 204 to receive a dowel pin 212. The pair of pins 206 extend from the head flange 202. Two holes are formed in the first and second limbs 14, 16 to receive the pair of pins 206 to prevent rotation of the rotation timing housing 200 relative to the first and second limbs 14, 16.

With reference to FIGS. 22-25, the multi-position adjustable draw weight plate 250 preferably includes a draw weight plate 158 and the cable post 114. Threaded position holes 142, 144, 146 and 148 are formed through the draw weight plate 158 to threadably receive the anchor cable post 114. A dowel hole 162 is formed through an end of the draw weight plate 158 to receive the dowel pin 212. The multi-position adjustable draw weight plate 250 is secured in the timing housing 200 by pressing the dowel pin 212 into through the dowel holes 162, 210.

Figure 3:
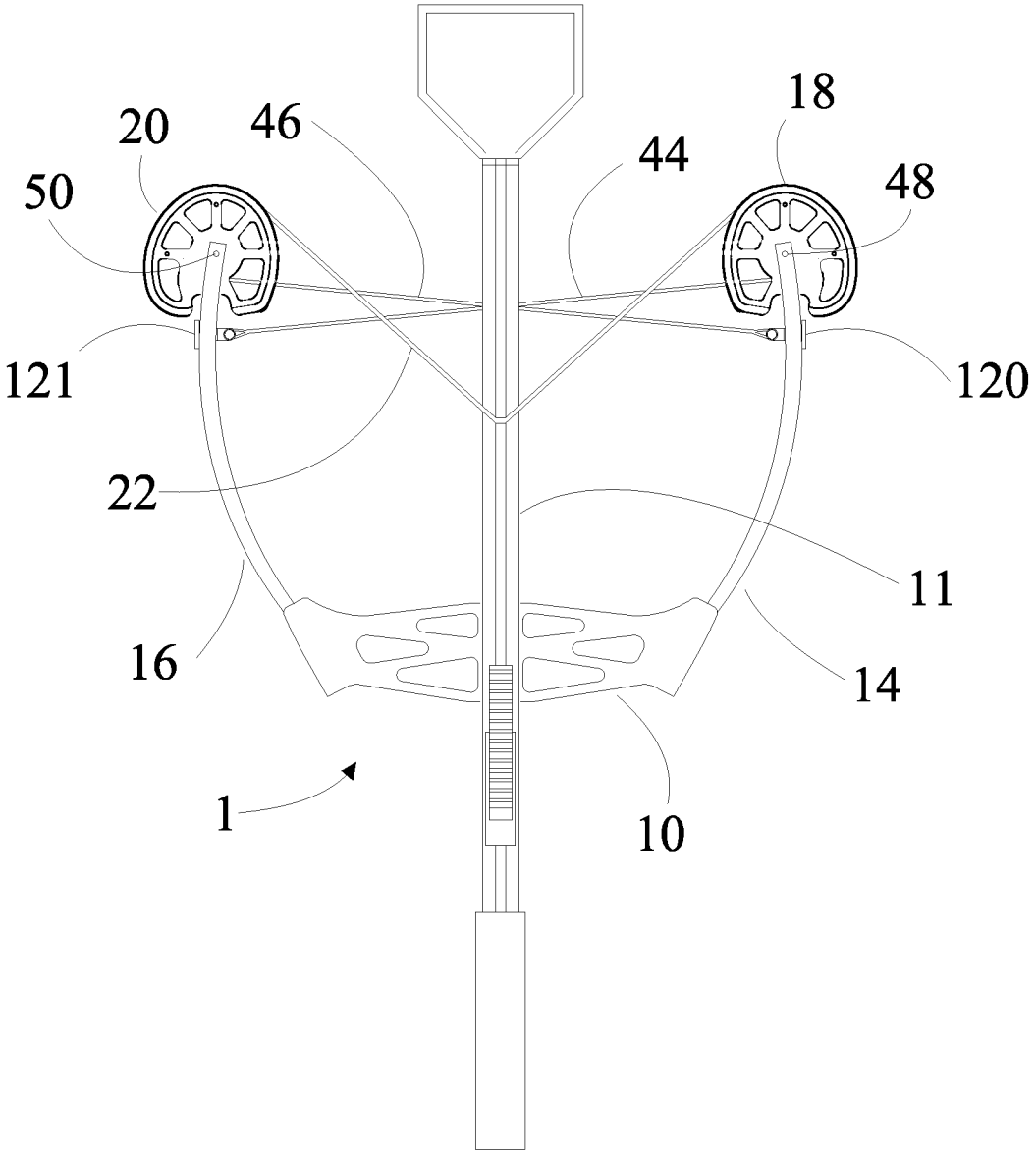
FIG. 3 is a top view of an archery crossbow, where the second end of the first and second cables are coupled to the limbs at a first location, where the rotational timing adjustment assemblies are at a first position of the present invention.

With reference to FIGS. 3-4, one will be taught how the preferred embodiment accomplishes the proper timing of the strings guides on the shooting bow 1. Assume that the shooting bow 1 is strung in the typical fashion, and that the rotation of the first and second cams 18, 20 will be described in relation to a circle. We will use circle with degrees as reference wherein "0" degrees is the uppermost tangent point of the circle, and "180" degrees is the lowermost tangent point of the circle. Let us say the first cam 18 is at a position of "164" degrees, and the second cam 20 is at a position of "160" degrees. A tool is inserted into the hex cavity 118 of the second single position rotational timing hub 110, wherein the tool will be used to rotate the second single position rotational timing hub 110 in either a clockwise or counterclockwise direction, thus decreasing the length of the first cable 44. The second single position rotational timing hub 110 would be rotated until the second cam 20 is in time with the first cam 18.

With reference to FIGS. 1-2, the second cable 46 is secured to the first multi-position draw weight rotational timing adjustment assembly 160 and the first cable 44 is secured to the second multi-position draw weight rotational timing adjustment assembly 161. In the event that the timing of the first cam 18 is not in unison with the second cam 20, a tool may be inserted into the hex cavity 118 of the first single position rotational timing hub 110 or the second single position rotational timing hub 110. The tool is used to rotate the said first or said second single position rotational timing hubs 110 in either clockwise or counterclockwise directions in order to lengthen or shorten the first or second cables 44, 46.

With reference to FIGS. 1-2, to alter the draw weight of the shooting bow 1, the user releases pressure on the string guide supports 16 and 14, removes the second ends of the first cable 46 and the second cable 44 from the cable post 114, changes the location of the said cable post 114 of the multi-position draw weight rotational timing adjustment hub 160, then re-attaches the second ends of the first cable 46 and the second cable 44 to the cable post 114. Position 148 represents the lowest amount of draw weight for the shooting bow 1, position 146 represents a greater amount of draw weight than position 148, position 144 represents a greater amount of draw weight than position 146, and position 142 represents the greatest amount of draw weight for the shooting bow 1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A multi-draw weight archery bow with cable timing comprising:

a barrel;

a riser is attached to said barrel;

a first limb extends from a first end of said riser, a second limb extends from a second end of said riser;

a first cam is pivotally retained on a distal end of said first limb, a second cam is pivotally retained on a distal end of said second limb;

a bow string having a first end retained on said first cam, a second end of said bow string is retained on said second cam;

a first rotational timing hub is retained on a first side of said barrel, a second rotational timing hub is retained on a second side of said barrel;

a first cable having one end secured to said first cam, substantially a middle of a length of said first cable is retained on a first pulley secured on said second limb, a second end of said first cable is retained on said second rotational timing hub; and a second cable having one end secured to said second cam, substantially a middle of a length of said second cable is retained on a second pulley secured on said first limb, a second end of said second cable is retained on said first rotational timing hub, wherein said first rotational timing hub is capable of increasing or decreasing tension on said first cable, said second rotational timing hub is capable of increasing or decreasing tension on said second cable.

2. A multi-draw weight archery bow with cable timing of claim 1 wherein:

a first rotational timing housing includes a first hub bore, said first rotational timing hub is inserted through said first hub bore, said first rotational timing housing is attached to said second side of said barrel.

3. A multi-draw weight archery bow with cable timing of claim 1 wherein:

a second rotational timing housing includes a second hub bore, said second rotational timing hub is inserted through said second hub bore, said second rotational timing housing is attached to said first side of said barrel.

* * * * *